US006055715A

United States Patent [19]

Ni et al.

[11] Patent Number: 6,055,715

[45] Date of Patent: May 2, 2000

[54] METHOD FOR HYDROFORMING A HOLLOW SHEET METAL BODY PART

[75] Inventors: Chi-Mou Ni, Troy; Charles J. Bruggemann; William Henry Todd, Jr., both of Rochester Hills; Joseph Michael Lendway, IV, Dryden, all of Mich.

[73] Assignee: General Motors Corporation, Detroit, Mich.

[21] Appl. No.: 09/303,406

[22] Filed: May 3, 1999

[51] Int. Cl.[7] ..... B23P 17/00

[52] U.S. Cl. ..... 29/421.1; 72/61

[58] Field of Search ..... 29/421.1; 72/60, 72/57, 61, 54

[56] References Cited

U.S. PATENT DOCUMENTS 2,726,973 12/1955 Coral .
3,751,956 8/1973 Blanchi ..... 72/57
4,576,030 3/1986 Roper ..... 72/296
5,372,026 12/1994 Roper ..... 72/60
5,533,372 7/1996 Roper et al. ..... 72/60

*Primary Examiner*—S. Thomas Hughes
*Assistant Examiner*—John C. Hong
*Attorney, Agent, or Firm*—Charles E. Leahy

[57] ABSTRACT

A method for hydroforming a large surface area, double paneled, hollow auto body part, such as a hood, in which the inner and outer panels are concurrently shape formed and seamed structurally together in the same apparatus. A pair of upper and lower dies crush the edges of a double walled blank together between the dies so as to simultaneously clamp, seal, and form the seam. Then, a special face seal and fluid inlet assembly grips and holds the edges of an inlet hole near the center of the blank to allow the interior to be successfully pressurized and expanded.

8 Claims, 11 Drawing Sheets

METHOD FOR HYDROFORMING A HOLLOW SHEET METAL BODY PART

TECHNICAL FIELD

This invention relates to hydroforming methods in general, and specifically to a method for hydroforming a hollow automotive sheet metal body part of the type having large surface area inner and outer panels, such as a hood or trunk lid.

BACKGROUND OF THE INVENTION

Hydroforming, a process by which extremely high internal fluid pressure is used to expand the wall of an unshaped metal blank out into the inner surfaces of a shaped die cavity, is now extensively used to produce beam like, hollow structures. Examples include auto body frame rails and the like, in which a cylindrical blank is clamped between a pair of dies, plugged at the ends, and expanded out into a generally square or rectangular cross section. Only the ends of the blank need be sealed, which are relatively small and uniform in shape. Such plug type seals also provide an obvious point for pumping in (and draining out) the high pressure fluid, through inlet pipes passing through the center of the plug seals. Recent patents in the area are mostly variations of or additions to the basic beam forming process, in which holes can be simultaneously pierced through the beam wall, or flanges incorporated, or varying wall thicknesses produced. Generally, however, the part produced is still an elongated beam, whose surface area is very small relative to its length.

Less attention has been paid to hydroforming as a means to produce large surface area sheet metal auto body parts, such as hood and deck lids. Clearly, the sealing task involved would be much more difficult than merely plugging two small ends of a cylindrical tube blank. The entire perimeter edge of the sheet would have to be sealed. There are known methods and presses for hydroforming single layers of sheet metal. An example is disclosed in U.S. Pat. No. 5,372,026 issued Dec. 13, 1994 to Roper. Sealing is accomplished by tightly clamping the entire perimeter of the single sheet between peripheral lock beads of a pair of upper and lower dies. An upper, shaped die provides the surface against which the sheet blank is expanded, the shape to which the sheet will ultimately conform. A lower die simply provides the other side of the pressurized die cavity and may be flat or, at least, devoid of particular surface detail. The task of expanding the single sheet is straightforward, once its perimeter edge is clamped and sealed by the lock beads. Pressurized fluid need only be inlet through a convenient port or ports in the lower die. Such fluid cannot escape past the clamped peripheral edge of the sheet, and can only act to expand the sheet into the shaped upper die. The inlet ports through the lower die need not be sealed in any way, and can be simple, open passageways.

Single layer, formed metal sheets would have limited utility in producing auto bodies, however. Almost all large surface area parts, such as hood and deck lids, are hollow, with inner and outer panels structurally joined at a peripheral seam, for rigidity and strength. Each panel could be separately formed as described above, and then later edge fastened to the other. However, this would obviously require two dedicated presses, and the final step of structurally edge joining the two separately formed panels would require that the two be very accurately positioned relative to one another, in yet another fixturing and joining apparatus. The most basic advantage of a hydroforming operation is typically to avoid such later fabricating steps, in which a final part is built up from separate components. This saves time and, most importantly, the accuracy and quality of a one piece hydroformed part is "built in" within the die, and repeatable. To first hydroform two large area sheet metal panels and then later structurally join them into a final part would probably not be considered cost effective, in most cases, as compared to simply stamping out the two pieces first. However, there is no known method for producing such a two paneled part entirely within the die, in one step, or, more importantly, to successfully introduce pressurized fluid into the interior. There is no obvious, workable location for the introduction of such fluid, as with the plug seals used in a cylindrical blank, where an inlet can simply run through the center of the plug, or as with hydroforming a single sheet, where the fluid is simply introduced to the back of the sheet with no need for sealing.

SUMMARY OF THE INVENTION

The subject invention provides a method and apparatus for integrally forming a hollow, two paneled sheet metal part, in which both shaping and at least the primary structural edge joining task are carried out simultaneously, all within the dies. A suitable initial blank and means for successfully pressurizing its interior are also disclosed.

In the preferred embodiment disclosed, a pair of upper and lower dies are provided, each of which, not just one, has an inner surface designed to produce the exterior shape of one of the part panels. The dies have perimeter, interengaging lock beads similar to those used to clamp and seal a single sheet. Here, however, the initial forming blank is not a single sheet, but a large, hollow blank that has two sheets or walls, one presented to the forming surface of each die. Each wall of the blank has sufficient area to ultimately form one panel of the final part as well as the structural perimeter seam joining them. Each wall of the blank has at least a pair of peripheral edges, each of which is opposed to a matching peripheral edge of the other blank wall, and alignable with and between the upper and lower die lock beads. When the blank is aligned between and clamped between the upper and lower dies, the opposed pairs of blank wall edges are crimped together to form the structural peripheral seam, which also acts to seal the interior space between the two walls. The walls are also partially flattened into rough conformance with the die forming surfaces.

The lower wall of the blank contains a non circular inlet hole which is matched in shape and aligned with an inlet port and face seal assembly that opens through the lower die. The inlet port is oblong in shape, with a liftable and retractable gripper inside. When the blank is fully clamped in place, the gripper is lifted through the inlet hole, turned and retracted so as to grip the inside edge of the inlet hole and hold the outside edge of the hole tight to the face seal. Now, highly pressurized fluid can be introduced in a sealed fashion between the blank walls, expanding them into the forming surfaces of the dies to form the two panels of the part. When removed from the die, the formed part may have additional operations performed to the perimeter seam, such as trimming, hemming or even welding. However, the two panels will be basically structurally joined already, with an accuracy created by the solid interior surfaces of the die cavity.

BRIEF DESCRIPTION OF THE DRAWINGS

These and other features of the invention will appear from the following written description, and from the drawings, in which.

DESCRIPTION OF THE PREFERRED EMBODIMENT

Figure 1:
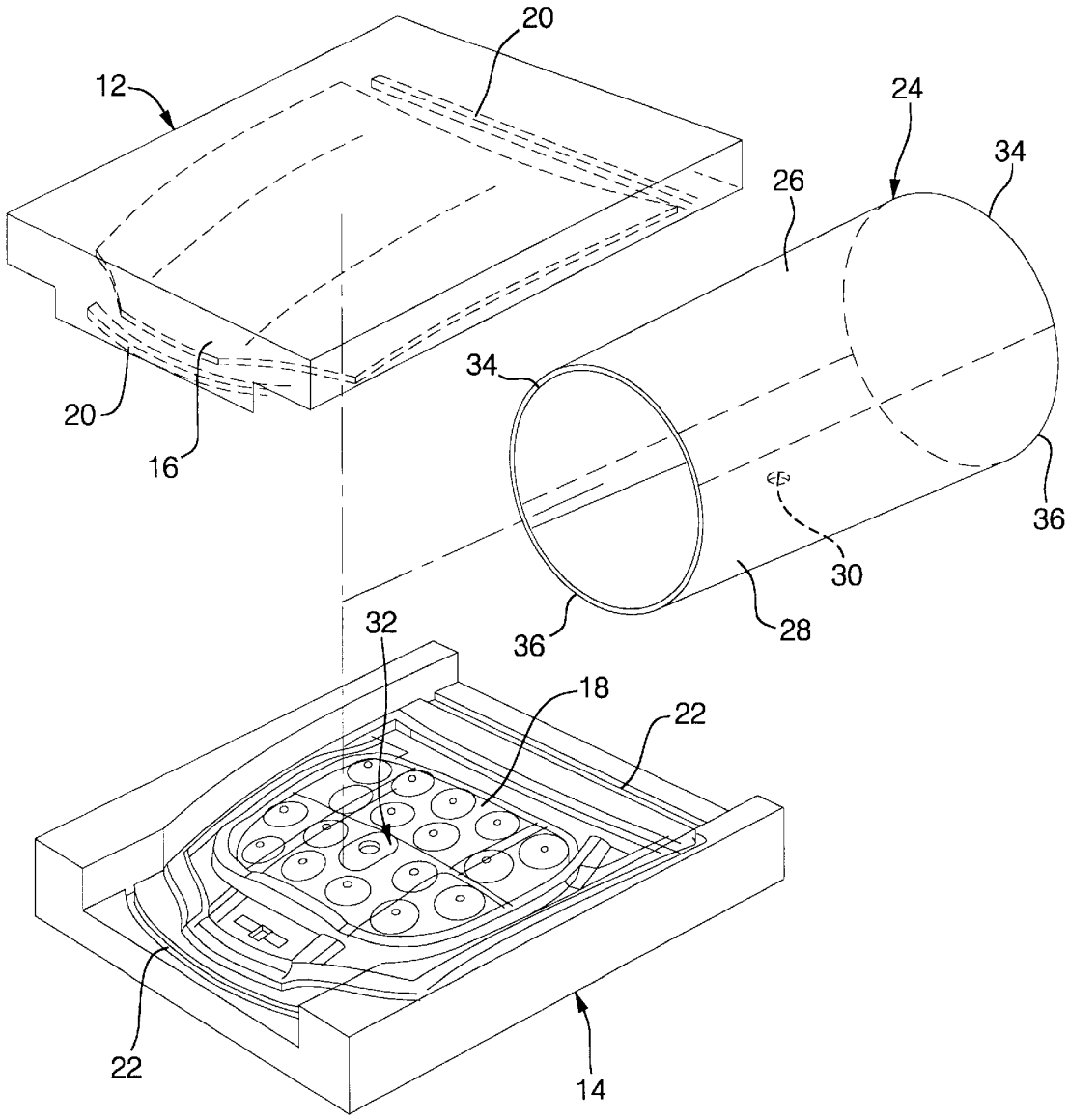
FIG. 1 is a perspective view of a pair of dies and one embodiment of a blank.
Figure 2:
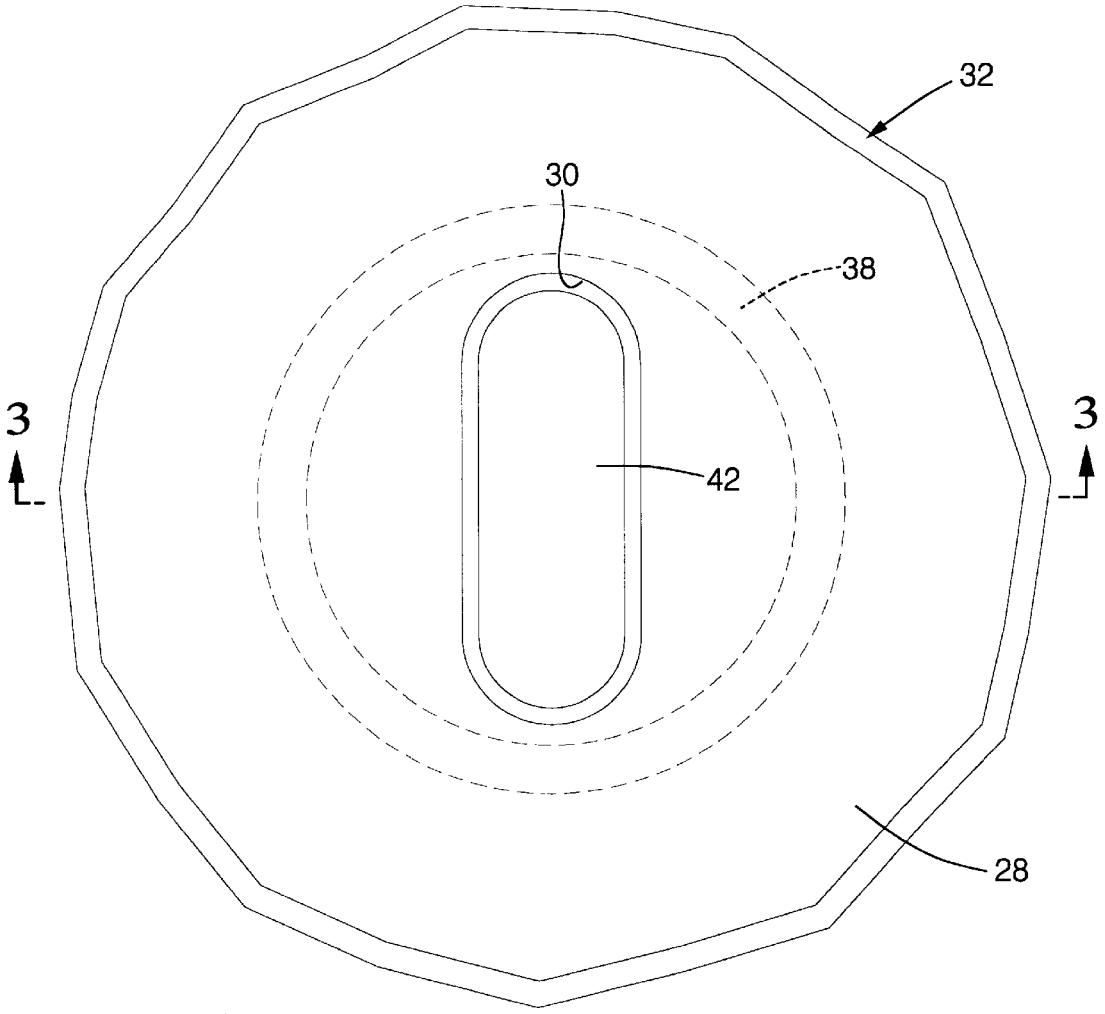
FIG. 2 is a plan view of the fluid inlet and face seal assembly deactivated.
Figure 3:
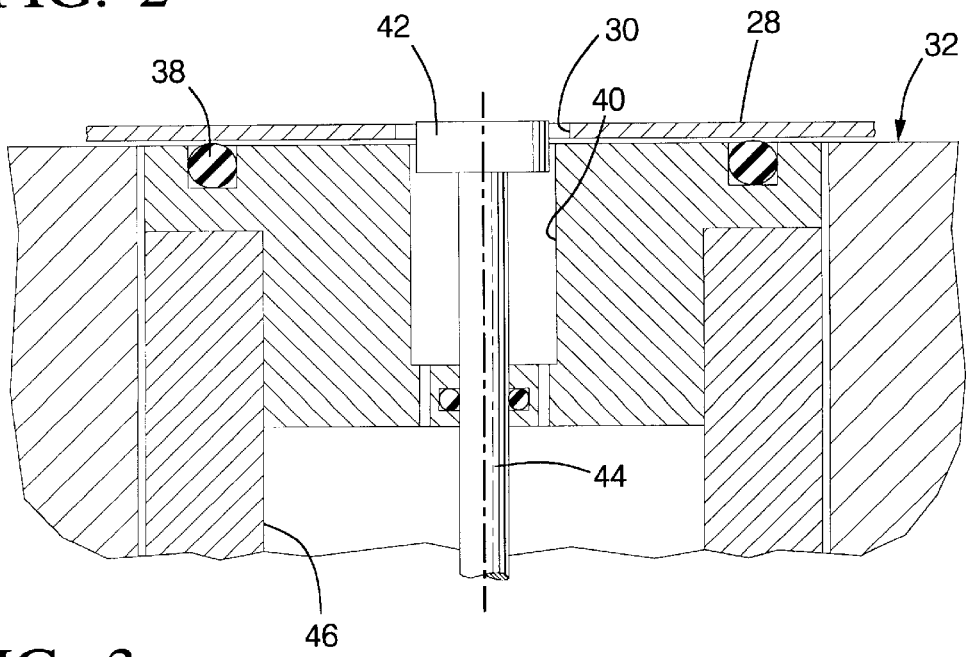
FIG. 3 is a cross section of FIG. 2 taken along the line 3—3 of FIG. 2.
Figure 4:
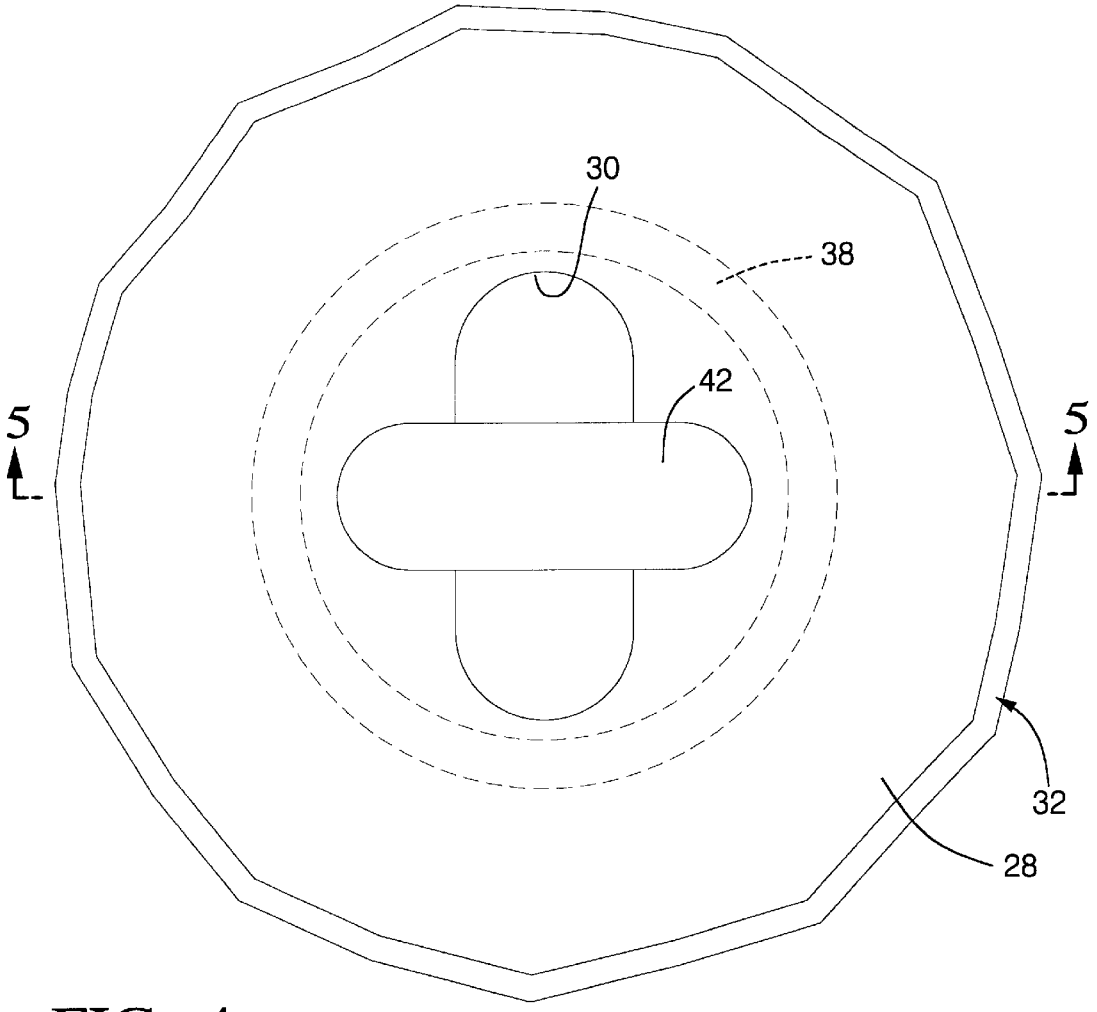
FIG. 4 is a plan view of the fluid inlet and face seal assembly activated.
Figure 5:
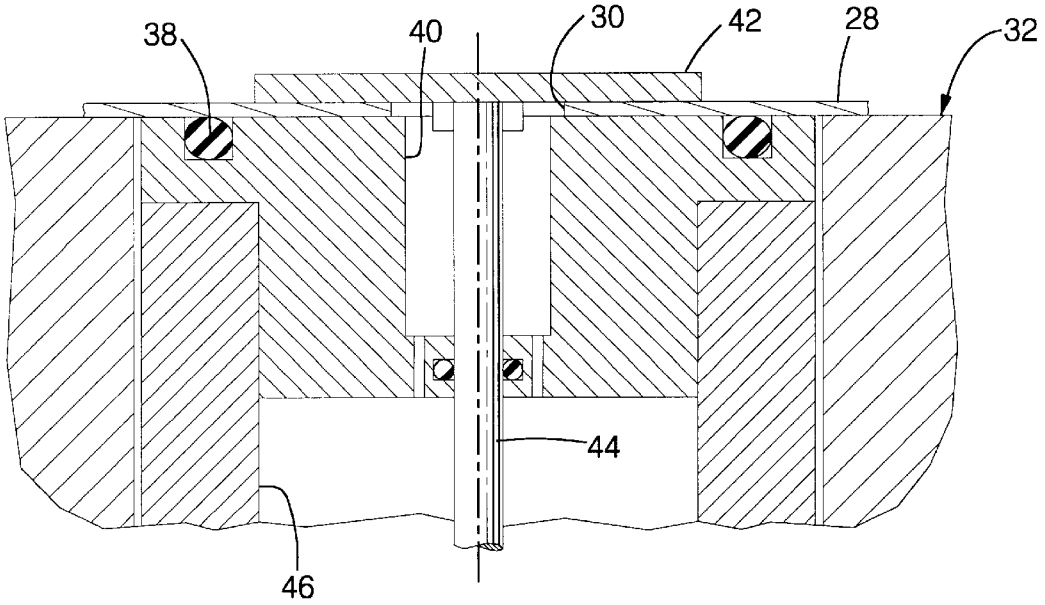
FIG. 5 is a cross section of FIG. 4 taken along the line 5—5 of FIG. 4.
Figure 6:
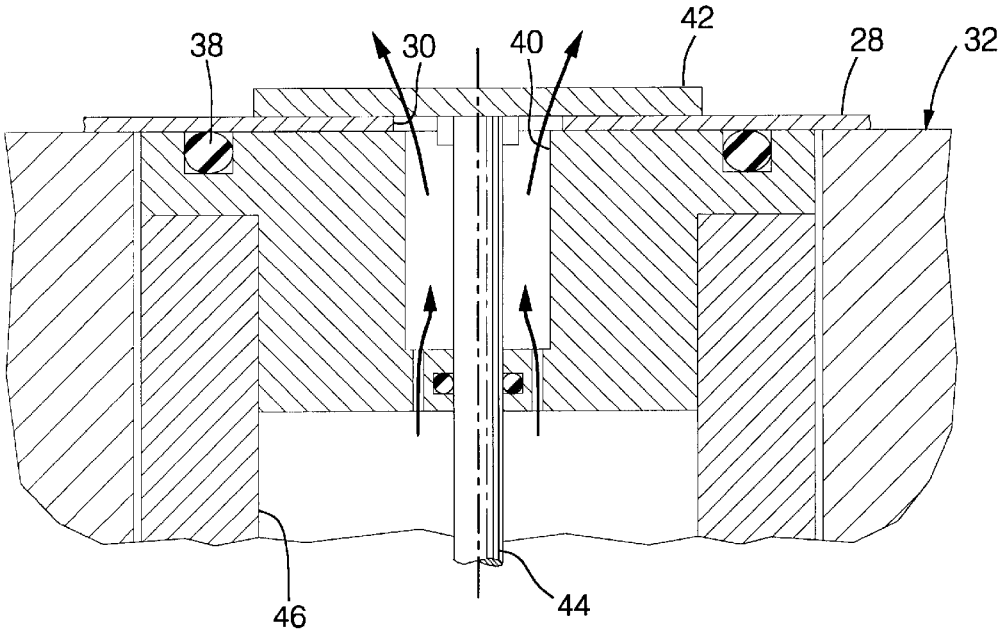
FIG. 6 is a view like FIG. 5, showing the introduction of pressurized fluid into the interior of the blank.

Referring first to FIG. 1, an upper hydroforming die, indicated generally at 12, and a lower die, indicated generally at 14, would be held within a conventional press apparatus, including a press base for lower die 14 and a slide to move upper die 12. The dies 12 and 14 are each solid, generally rectangular, machined steel blocks with an inner surface that matches the outer surface desired for the formed part. The part to be formed is an automotive body hood, and the interior surface 16 of upper die 12 is shaped to produce the outer panel of the hood. It is, therefore, substantially smooth, with a slight overall curve and little surface detail. The inner surface 18 of lower die 14, on the other hand, is more complex, comprising a regular series of protrusions that ultimately produce stiffening corrugations in the inner panel of the hood. These shapes will differ widely, of course, depending on the part to be produced, but, in any case, the peripheral edges of the inner and outer panels of the final part will have to be structurally jointed together along a perimeter seam. To that end, each die 12 and 14 has a peripheral lock bead, details of which are described next.

Figure 9:
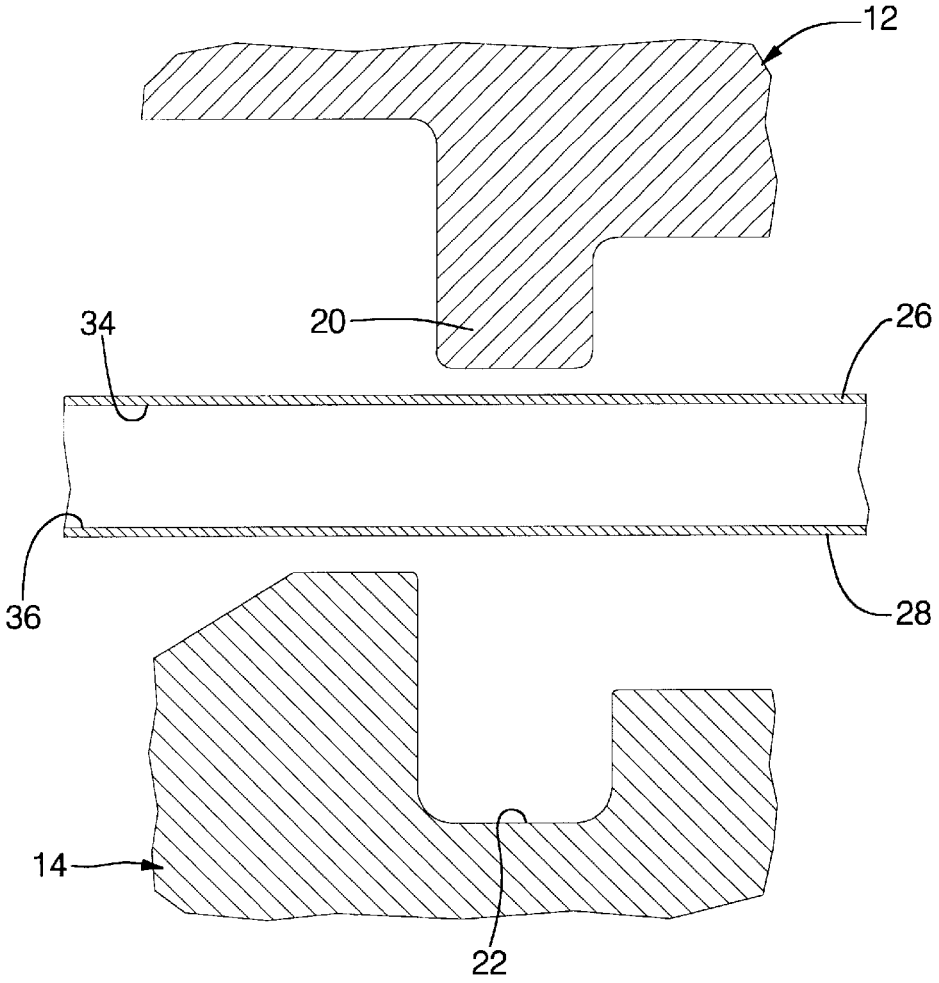
FIG. 9 is a cross section through the die lock beads and a pair peripheral edges of the blank prior to complete closing of the dies.
Figure 10:
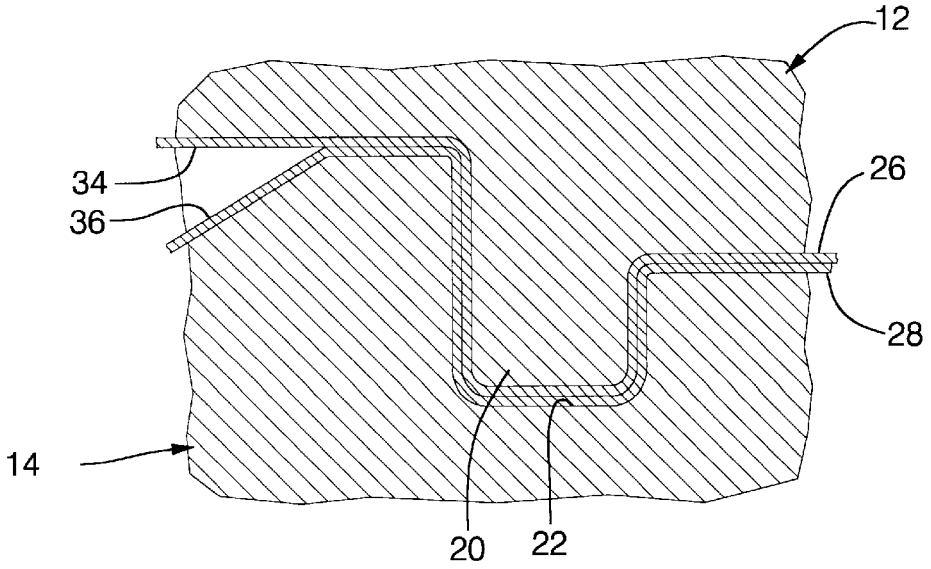
FIG. 10 shows the perimeter seam formed by complete closing of the die lock beads.

Referring next to FIGS. 9 and 10, upper die 12 has a male perimeter lock bead 20, which fits within a female perimeter lock bead 22 on lower die 14. The male bead 20 fits within the female bead 22 closely, when the dies 12 and 14 close, but with a deliberate spacing between them, described in more detail below. Here, the lock beads 20 and 22 extend along only two opposed edges of the generally rectangular die perimeter, not all four sides, as is usual, but, the interfitting lock beads 20 and 22 are, in shape and basic operation, essentially similar to that which has been used on stamping and drawing presses in the past. In general, lock beads, sometimes called locking draw beads, are used to clamp around the perimeter of a single metal sheet, as in the patent discussed above, in order to restrict metal flow, that is, to hold the metal fast and prevent its inward flow. This, as opposed to a conventional draw bead, which does not totally restrict metal flow, but allows the sheet to slip through with some restriction as it is pulled through to prevent or restrict wrinkling in the sheet as it is stretched. In the instant invention, the locking draw beads do act as a clamp and hold the sheet edges but, in addition, provide two novel features and functions, as described in more detail below.

Referring again to FIG. 1, the locking beads 20 and 22 are designed to interact uniquely with specific structural features of a novel blank used in the process, indicated generally at 24. The sheet metal blank 24 disclosed is a large, cylindrical sheet steel cylinder or hoop, which can be conceptualized as having an upper wall 26 over its upper 180 degrees, and a lower wall 28 over the lower 180 degrees, as divided by the parallel dotted lines. While these designations are somewhat arbitrary, they are useful insofar as they demarcate those portions of the outer surface of the blank 24 that will be ultimately be formed against the upper die 12, and those that will be formed against the lower die 14. And while there would normally be no way to distinguish upper from lower in a uniform, cylindrical hoop, here there is a hole 30 of particular shape cut into what by definition is the lower wall 28. Inlet hole 30 is alignable with a fluid inlet and face seal assembly, designated generally at 32, contained in the lower die 14. More detail on these features is given below. After so designating and demarcating the blank 24, the upper and lower blank walls 26 and 28 may be further conceptualized as having two upper peripheral edges 34 and two lower peripheral edges 36 even though, in reality, there is only one continuous circular edge at each end of the cylindrical blank 24. These peripheral edges 34 and 36 as defined are arrayed in opposed pairs, one upper 34 and one lower 36, at each end of the blank 24. Each opposed pair of edges 34 and 36 is alignable, in turn, with and between a pair of opposed lock beads 20 and 22 at each end of the dies 12 and 14 as the blank 24 is aligned between the dies 12 and 14. At the same time, the inlet hole 30 centered over the fluid inlet and face seal assembly 32 in lower die 14.

Referring back to FIGS. 1, 9 and 10, at the beginning of the process, blank 24 is aligned between the dies 12 and 14 as just described. The dies 12 and 14 may be closed on and toward one another to flatten the blank 24 into a elliptical shape, causing it to fold down in live hinge fashion, generally following the dotted blank division lines. Concurrently, the opposed pairs of peripheral edges 34 and 36 move toward one another between the approaching pairs of lock beads 20 and 22. Eventually, when the dies 12 and 14 have fully closed, the male lock beads 20 enter the matching female lock beads 22, with just enough space between to accommodate two sheet thicknesses, not just one. The opposed pairs of blank wall peripheral edges 34 and 36 are thereby forced tightly together to form a trough like structural perimeter seam. In addition, there is enough surface area that a flange of some excess material left outboard of the trough shaped seam. Once the seam has been formed by the lock beads 20 and 22, the upper and lower walls 26 and 28 are locked into the dies 12 and 14 in preparation for pressure forming against the die surfaces 16 and 18, just as a single sheet or wall would be in a conventional stamping or stretch forming die. In addition, the two pairs of edges 34 and 36 are structurally joined together, simultaneously to being locked in place in the dies 12 and 14. That is, the edges 34 and 36 are solidly located relative to one another, even if they would still be theoretically capable of being forcefully pulled apart. These are features not provided by a lock bead that simply clamps onto the edge of a single layer or sheet. Furthermore, an interior space between the walls 26 and 28 is thereby fluid sealed, but for the inlet hole 30. How inlet hole 30 is handled is described next.

Referring next to FIGS. 3 through 6, the fluid inlet and face seal assembly 32 is inset substantially flush into the lower die surface 18, effectively replacing one of the surface protrusions therein. There is no particular necessity that it be incorporated in the lower die 14, but it is generally the lower die base within which fluid passageways can be more easily incorporated. The substantially central location of assembly 32 is also ideally suited to injecting pressurized fluid and distributing it evenly into the sealed blank interior. An O ring type face seal 38 surrounds an oblong or non circular fluid inlet port 40, which the inlet hole 30 is sized to match. Within inlet port 40, a shape matched gripper 42 on a rotatable post 44 is capable of being lifted, turned ninety degrees, and retracted back down tightly, as moved by any suitable mechanism within the lower die press base, not illustrated. Pressurized fluid is supplied to the inlet port 40 through a suitable passage way 46 in lower die 14. When the blank 24 is clamped between the dies 12 and 14, the outer surface of lower wall 28 is compressed, at least partially, against the face seal 38, surrounding the inlet hole 30. Then, the gripper 42 is lifted into the blank interior, turned, and pulled back downwardly, thereby pulling the outer surface of lower wall 28 surrounding inlet hole 30 into, assured fluid tight engagement with the face seal 38. The non circular shape of gripper 42 and hole 30 allows for this entry, turning and gripping action. In addition, by turning gripper 42 ninety degrees to the elongated inlet hole 30, a good deal of open area is unblocked to allow the introduction of pressurized fluid from passageway 46 through port 40, hole 30 and ultimately into the sealed interior space between the blank walls 26 and 28. Again, that interior space is sealed by both the seamed edges 34 and 36 and, now, by the face seal 38 as well. The face seal 38 prevents pressurized fluid from invading an area between the lower wall 28 and the lower die's inner surface 18, which would jeopardize the complete forming of the lower wall 28. Both walls 26 and 28 are expanded out by the pumped fluid, held at the edges by the lock beads 20 and 22, and forcefully molded into the respective die surfaces 16 and 18 to take on their shape.

Figure 7:
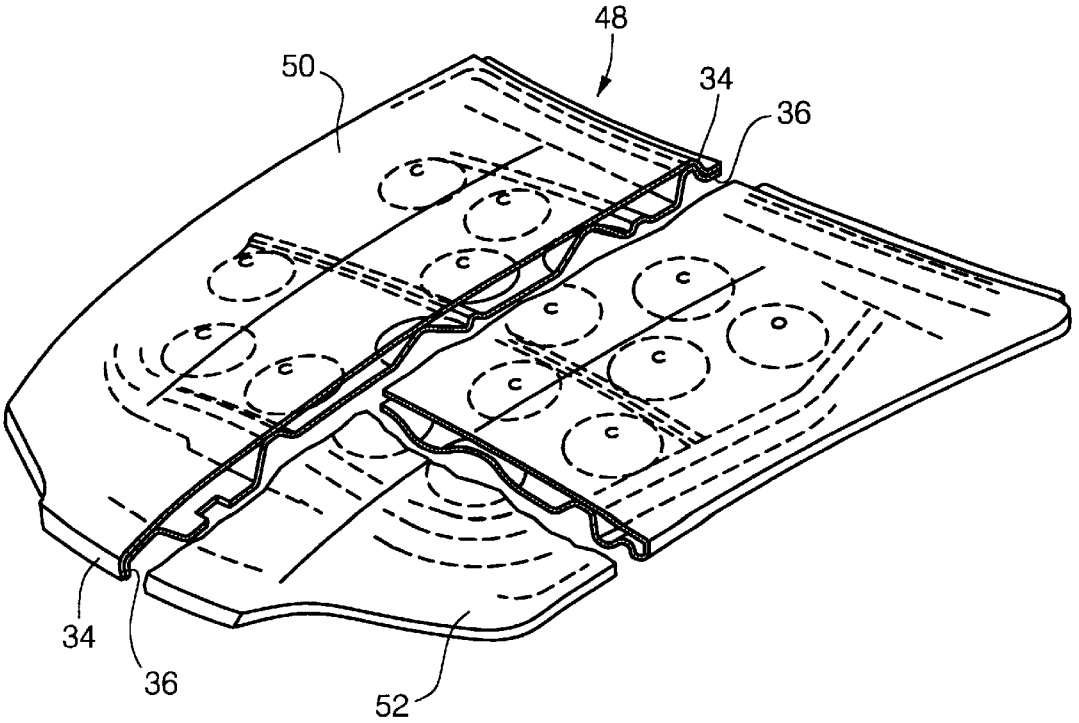
FIG. 7 is a perspective view of the formed part, prior to final edge dressing.
Figure 8:
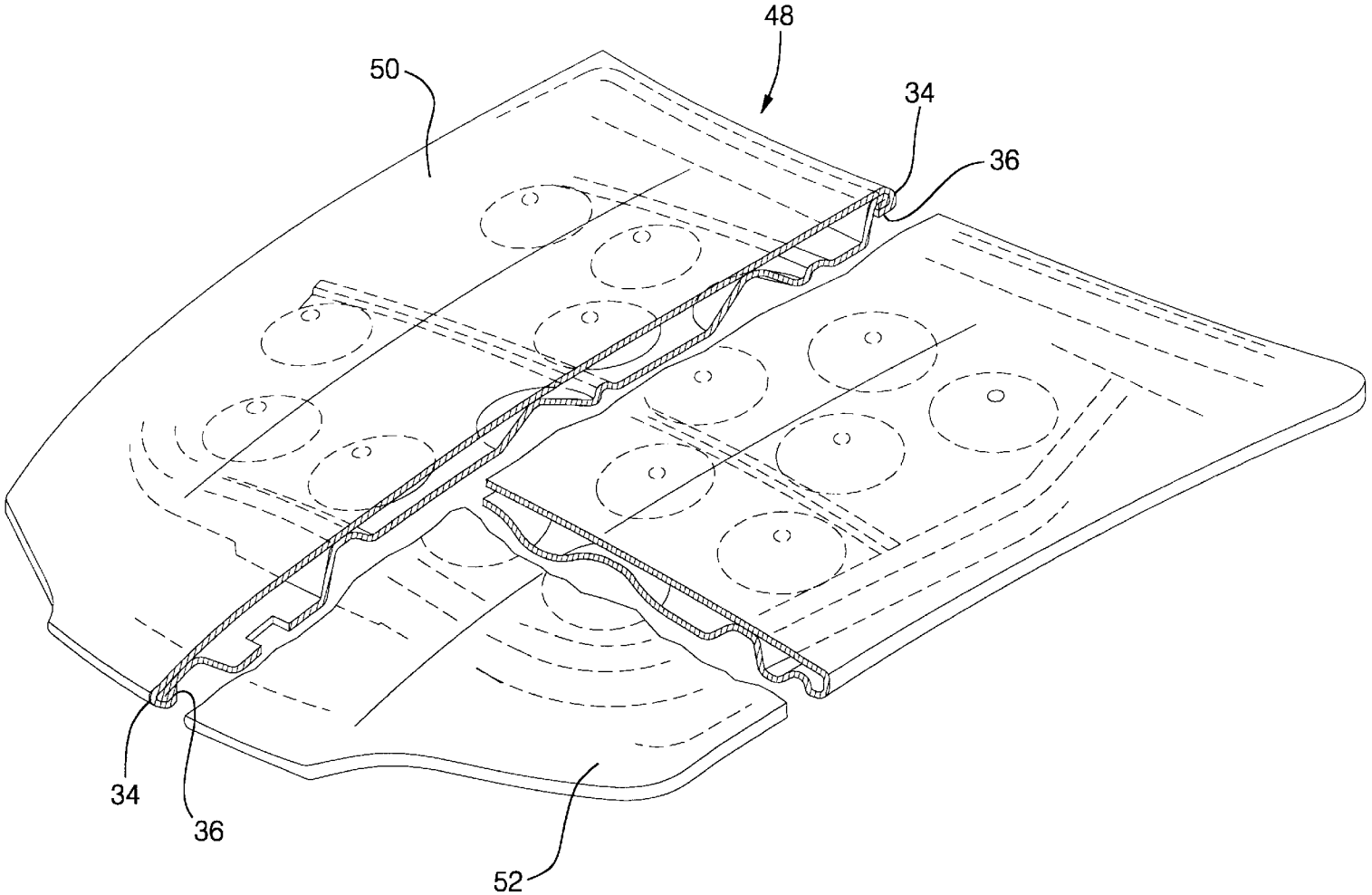
FIG. 8 is a perspective view of the formed part after final edge dressing.

Referring next to FIGS. 7 and 8, the formed part removed from the dies 12 and 14 is now a basic, hollow auto body hood, indicated generally at 48, with an outer panel 50 and an inner panel 52. It needs only some final processing steps around the front and back edges 34 and 36, as the side edges are integral and smooth. As shown in FIG. 7, the flange of excess material referred to above has already been cut off. Further operations to dress the edges 34 and 36 may be desired. As seen in FIG. 8, the trimmed edges 34 and 36 have been turned under in a so called hemming operation. In addition, a spot or laser welded operation could be performed as a last step to provide very solid joining of the edges 34 and 36. All of the post forming edge operations are rendered easier, however, by the fact that the edges 34 and 36 are already rigidly located relative to one another, as are the panels 50 and 52, with no fixturing needed, as would be the case if two separately formed panels were later edge joined. The hood 48 is rendered even more solid, in the embodiment disclosed, because of the integral side edges formed from the folded down sides of the cylindrical blank 24 disclosed. The locational accuracy and shape of the panels 50 and 52, both, are repeatably built in within and by the dies 12 and 14.

Variations in the preferred embodiment could be made. For example, a different blank could be rough formed of two initially entirely separate sheets that were sufficiently pre shaped to form at least a shallow cavity therebetween, and then tack welded around the edges or otherwise pre joined sufficiently to allow them to be handled as a unit. Such a composite blank would then be aligned and located between the dies 12 and 14 as was blank 24, with a similar inlet hole 30 in the lower sheet. Such a blank would have the advantage of not having to be crushed down and flattened as much as the hoop shaped blank 24, but it would also need dies with lock beads running along all four sides. Such dies would form flanged seams running along all four sides that would have to be dressed post forming. The large cylindrical blank 24, with edges 34 and 36 at only the ends, is easier to seal within the dies 12 and 14, requires less post forming edge dressing, and can potentially provide a stiffer hood because the inner and outer panels 50 and 52 are joined by two solid, integral sides, and joined by peripheral edge seams only at the front and back ends, not all the way around. A different shaped gripper 42 and matching hole 30 could be used. Any shape except purely circular, even square or triangular, would provide some measure of gripper-to-inlet-hole edge overlap needed for the gripping action shown, and would also serve to open up area for fluid flow. The elongated shape shown provides a large gripping overlap and also opens up a large flow area, however. Therefore, it will be understood that it is not intended to limit the invention to just the embodiment disclosed.

Figure 11:
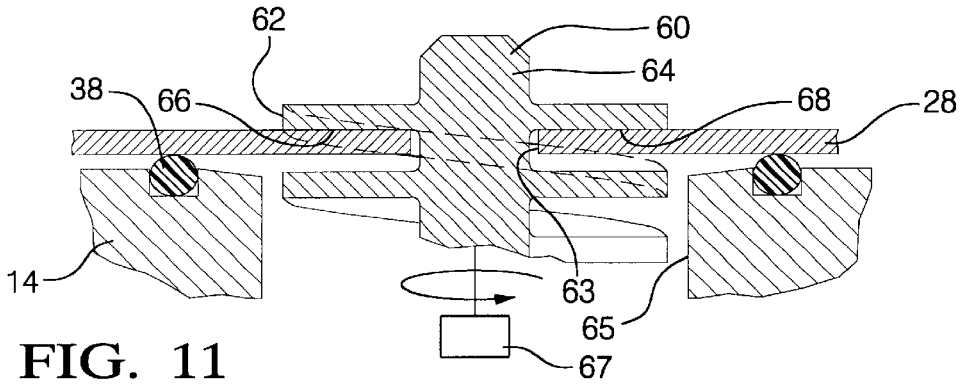
FIGS. 11–14 show a second embodiment of the gripper mechanism for engaging the lower blank wall against the face seal assembly.

Referring to FIGS. 11–14 a gripper 60 is provided in the form of a double helix screw. The screw 62 includes the rectangular end point 64 which is sized to be slightly smaller than a corresponding rectangular hole 63 provided in the lower wall 28. As seen in FIG. 11 the gripper 60 is housed in a bore 65 of the lower die 14 so that the rectangular end point 64 projects into the sealed interior space between the blank walls 26 and 28, when the lower blank is placed on the die.

Figure 12:
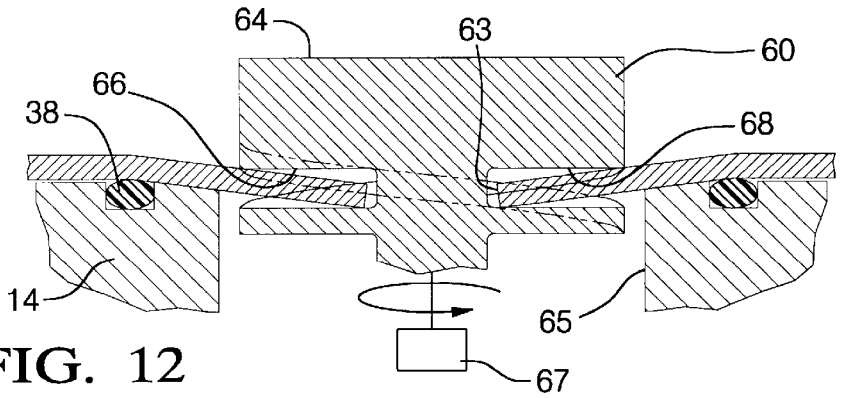
Figure 13:
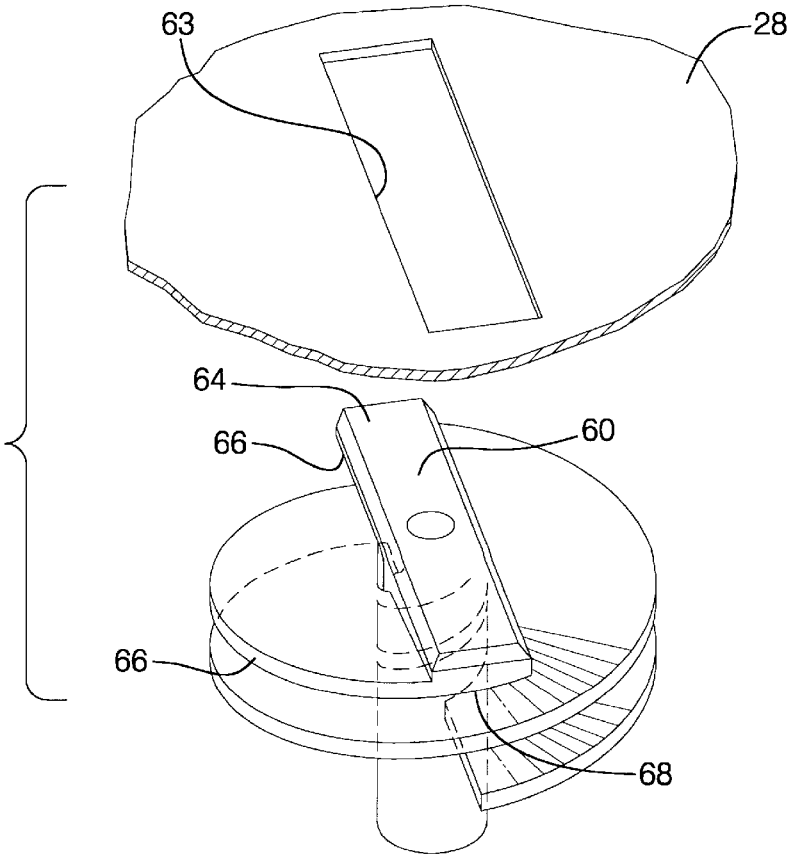
Figure 14:
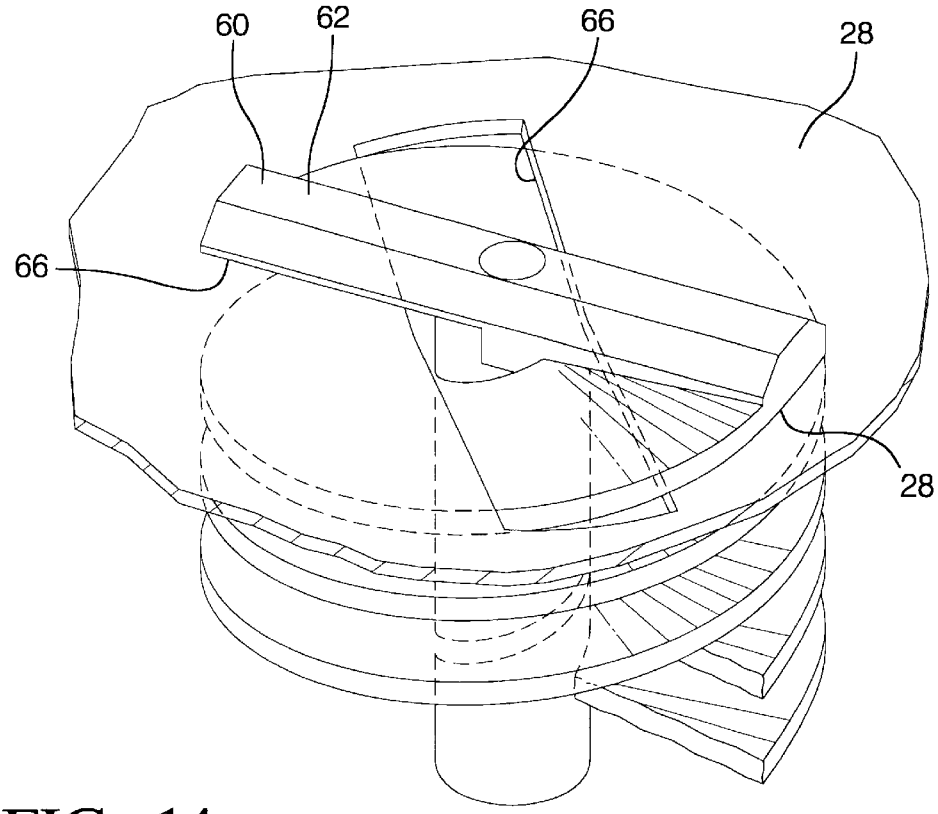

Then, rotation of the screw 62 by rotary actuator will cause the respective helical undersurfaces 66 and 68 of screw 62 to progressively engage with the edges of the lower blank wall 28 to provide a retracting force which forcibly engages the lower wall 28 downwardly onto engagement with face seal 38 as assured by bending of the lower wall 28 as shown in FIG. 12. Pressurized fluid is then introduced through the space between the threads of the screw 62 and through the rectangular opening 63 to forcibly mold the blank walls 26 and 28 respectively against the upper and lower dies. Screw 62 is then rotated back to the initial position in which rectangular end point 64 is again registered with the rectangular opening 63 for removal of the formed part.

Figure 15:
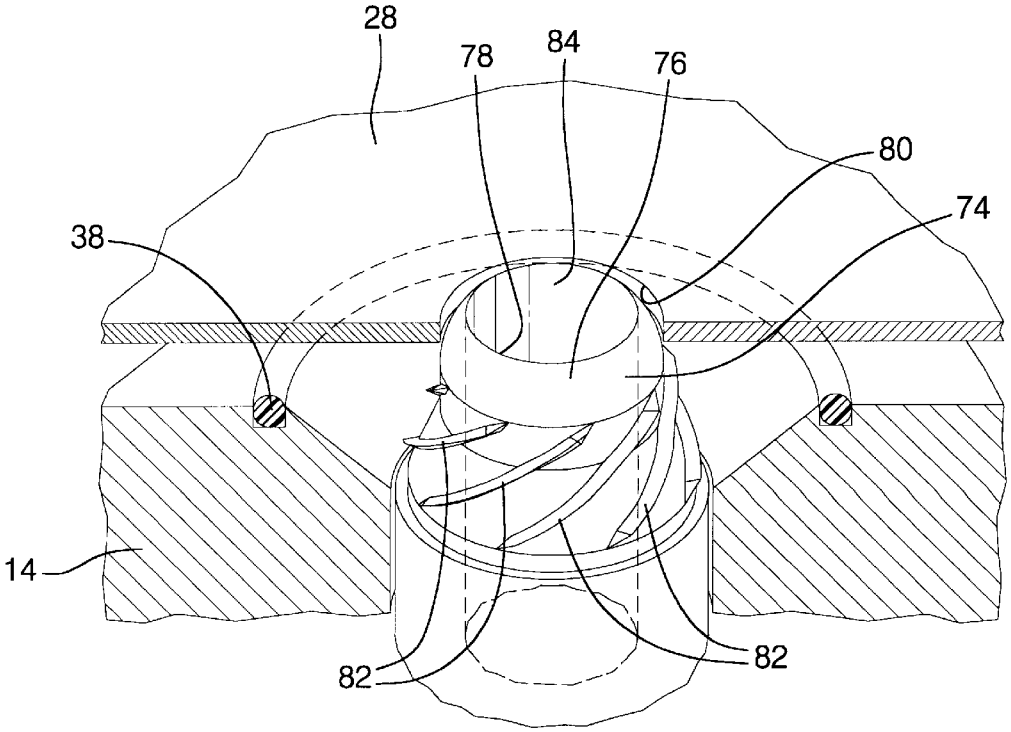
FIGS. 15–17 show a third embodiment of the gripper mechanism for engaging the lower blank wall against the face seal assembly.
Figure 16:
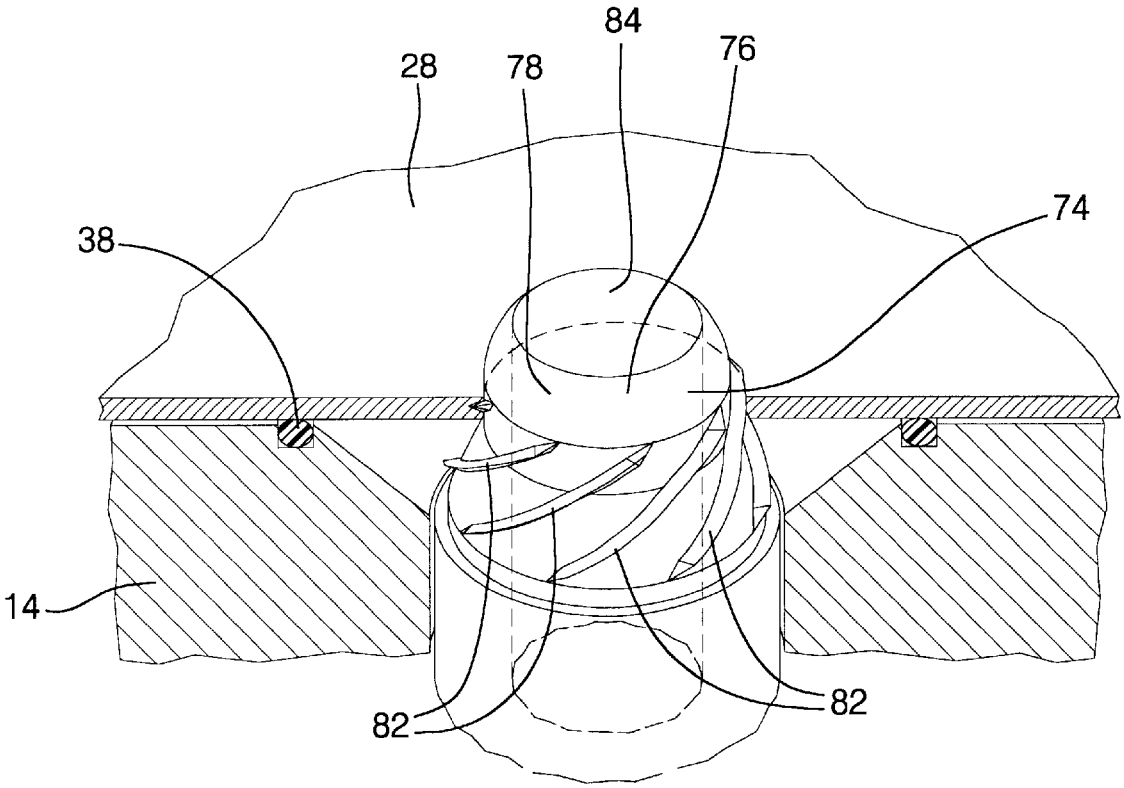
Figure 17:
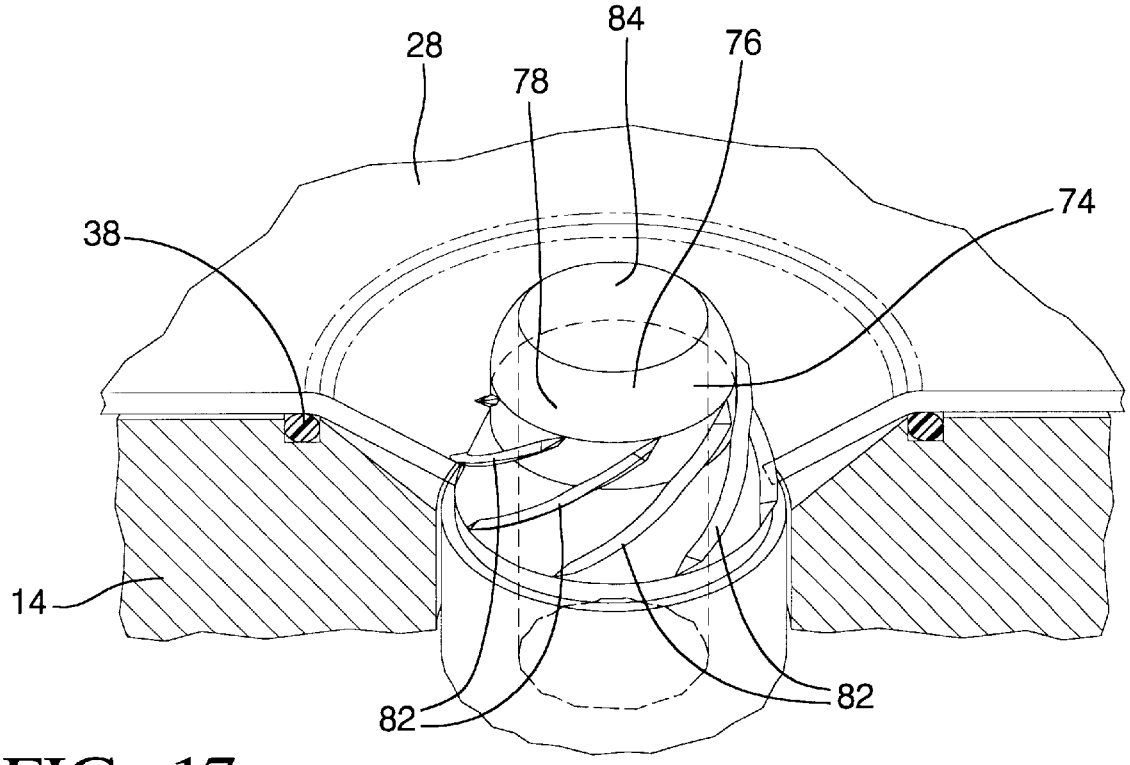

FIGS. 15 through 17 show yet another embodiment of the gripper in which a gripper 74 is comprised of a tapered multi-lead screw 76 having a chamfered blunt end 78 which registers with a circular hole 80 in the lower wall 28. The screw 76 has multiple helixes 82 of a self-tapping design which upon rotation of the screw 76 will cut into the lower wall 28 and forcibly retract the lower wall 28 onto engagement with the seal 38 as assured by bending of the lower wall 28 as shown in FIG. 17. The gripper 74 has a central bore 84 for communicating fluid into the sealed interior space between the blank walls 26 and 28. It will be appreciated that the screw 76 can be actuated by a rotary actuator such as a motor and there is no need to physically move the screw 76 up and down within the die as the self-tapping threads 82 will perform the gripping and retracting motion needed to seal the lower wall 28 against the seal 38. Alternatively, it may be desirable to mount the screw 76 and its rotary actuator as an elevator mechanism so that the screw 76 can be retracted below the surface of the lower die 14, and then raised through the opening 80 after lower blank wall is loaded onto the lower die 14.

Figure 18:
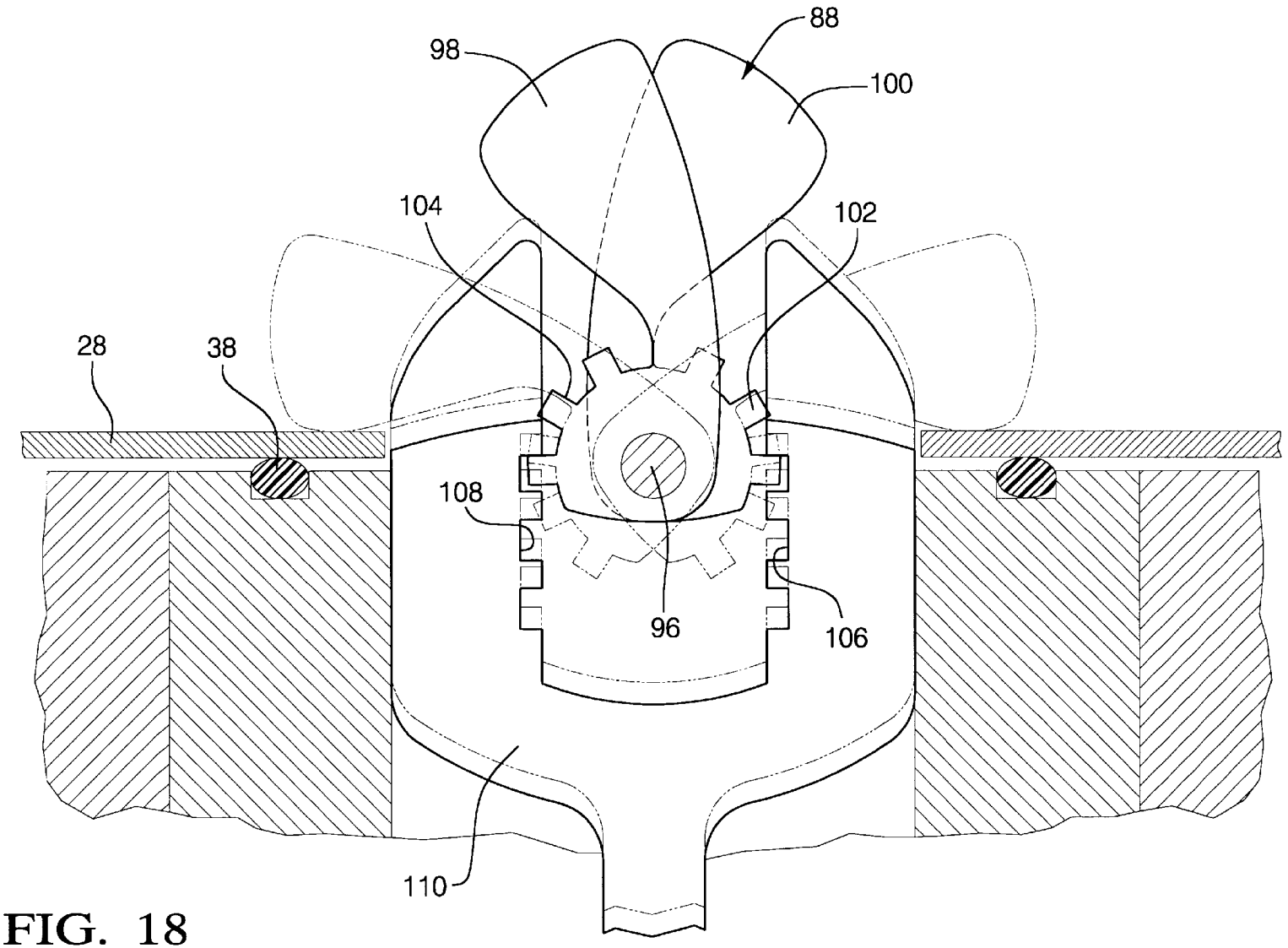
FIGS. 18–20 show a fourth embodiment of the gripper mechanism for engaging the lower blank wall against the face seal assembly.
Figure 19:
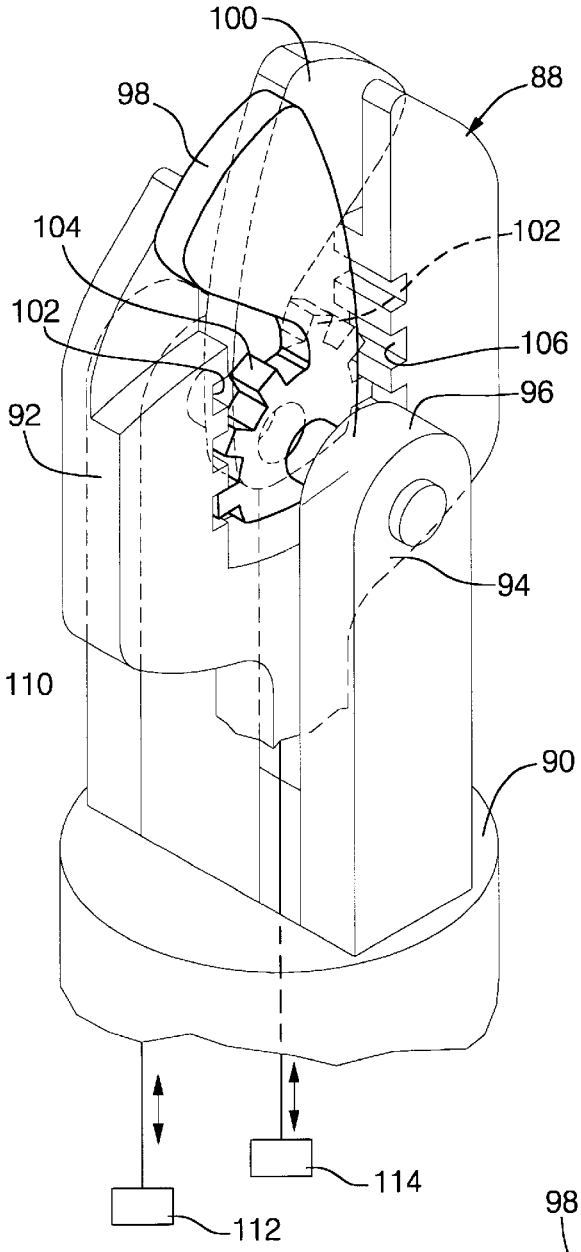
Figure 20:
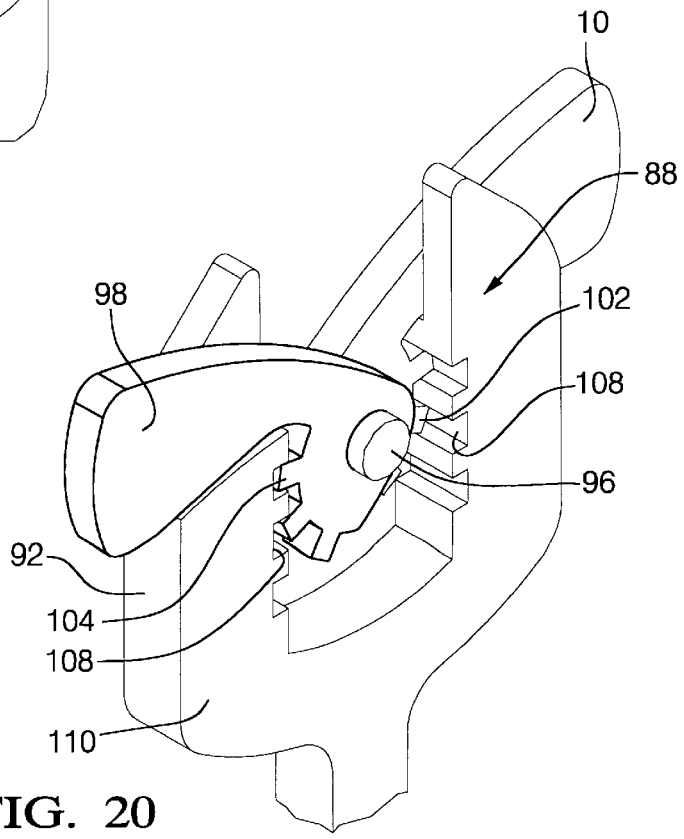

FIGS. 18 through 20 show yet another gripper device. In FIG. 19 the gripper device generally indicated at 88 includes a housing 90 having spaced trunnion arms 92 and 94 which mount a pivot shaft 96. Gripper arms 98 and 100 are rotatably mounted on the pivot shaft 96 and have respective gear teeth 102 and 104 thereon which mesh with rack teeth 106 and 108 provided on a fork shaped actuator plunger 110. The actuator plunger 110 is slidably mounted within the housing 90. A linear actuator 112 mounts the housing 90 on the lower die 14. A linear actuator 114 acts between the housing 90 and the actuator plunger 110. As best seen in FIG. 18, the housing 90 has been lifted upwardly by linear actuator 112 so that the gripper arms 98 and 100 are positioned inside the sealed interior space between the blank walls 26 and 28. Then the actuator plunger 110 is withdrawn downwardly so that the gripper arms 98 and 100 are forcibly pivoted from their normal position of FIG. 18 to the retracted position, which is shown in FIG. 20. Accordingly, the gripper arms 98 and 100 will forcibly seal the lower wall 28 against the face seal 38. If desired, the housing 90 may also be retracted downwardly somewhat to obtain the sealing of the lower panel 28 against the face seal 38. After pressurized fluid has deformed the blank walls against the dies, the gripper 88 is withdrawn by returning the gripper arms 98 and 100 to their ungripping position of FIG. 19 and then retracting the gripper 88 downwardly. Alternatively, if the interior space 50 between the blank walls 26 and 28 is of sufficient height, the housing 90 may be fixedly mounted within the lower die 14 with the gripper 88 extending above the surface of the lower die 14 and the entire gripping action is obtained via the rotation of the gripper arms 98 and 100 between their ungripping position of FIG. 19 and the gripping position of FIG. 20 by the linear actuator 114.

Thus, it is seen that the method for shaping a hollow sheet metal automotive body part can be performed in conjunction with a variety of gripper mechanisms which may be designed to grip the lower blank 28 and pull it into sealing encasement with the face seal 38.

What is claimed is:

1. A method for simultaneously shape forming a hollow, sheet metal automotive body part and joining first and second panels thereof together at a structural perimeter seam, comprising the steps of;

providing a hollow walled sheet metal blank having upper and lower walls, each wall having at least two peripheral edges, each peripheral edge opposed to a peripheral edge of the other wall, said walls each being of an area sufficient to form a respective first and second panel plus said structural peripheral seam, providing an upper and lower hydroforming dies, each die having an internal forming surface matching the desired external shape of one panel of said part, said upper and lower dies each having mating perimeter lock beads adapted to close tightly together over said sheet metal blank opposed peripheral edges as said upper and lower dies are closed together, providing a fluid inlet and seal assembly opening through the inner surface of one die, said fluid inlet and seal assembly having a face seal surrounded inlet port with a non circular shape and a liftable, rotatable and retractable gripper arrayed within said inlet port, providing an inlet hole in the one blank wall associated with said one die with a shape substantially matching said inlet port and alignable therewith when said blank is aligned between said dies, aligning said blank walls with and between said respective dies and closing said dies forcefully together, thereby clamping said blank wall peripheral edges together to simultaneously form said structural peripheral seam while concurrently sealing an interior space between said blank walls, lifting, rotating and retracting said gripper, thereby pulling the outer surface of said one blank wall tightly against said inlet port and face seal, and, injecting pressurized fluid through said inlet hole to expand said interior space and force said blank walls into said respective die forming surfaces while preventing the loss of pressurized fluid past said face seal and between said one blank wall and its respective die forming surface.

2. A method for simultaneously shape forming a hollow, sheet metal automotive body part and joining inner and outer panels thereof together at a structural perimeter seam, comprising the steps of;

providing a generally cylindrical sheet metal blank having upper and lower walls, each wall having a pair of peripheral end edges, each peripheral edge opposed to a peripheral end edge of the other wall, said walls each being of an area sufficient to form a respective outer and inner panel plus said structural peripheral seam, providing an upper and lower hydroforming dies, each die having an internal forming surface matching the desired external shape of one panel of said part, said upper and lower dies each having mating perimeter lock beads adapted to close tightly together over said sheet metal blank opposed peripheral end edges as said upper and lower dies are closed together, providing a fluid inlet and seal assembly opening through the inner surface of said lower die, said fluid inlet and seal assembly having a face seal surrounded inlet port with an elongated, non circular shape and a liftable, rotatable and retractable gripper arrayed within said inlet port, providing an inlet hole in the lower blank wall associated with said one die with a shape substantially matching said inlet port and alignable therewith when said blank is aligned between said dies, aligning said blank walls with and between said respective dies and closing said dies forcefully together, thereby clamping said blank wall peripheral end edges together to simultaneously form said structural peripheral seam while concurrently sealing an interior space between said blank walls, lifting, rotating and retracting said gripper, thereby pulling the outer surface of said one blank wall tightly against said inlet port and face seal, and, injecting pressurized fluid through said inlet hole to expand said interior space and force said blank walls into said respective die forming surfaces while preventing the loss of pressurized fluid past said face seal and between said lower blank wall and lower die inner surface, thereby forming a final part having inner and outer panels having integral sides joined by peripheral seams at the ends.

3. A method for simultaneously shape forming a hollow, sheet metal automotive body part and joining inner and outer panels thereof together at a structural perimeter seam, comprising the steps of;

providing a generally cylindrical sheet metal blank having upper and lower walls, each wall having a pair of peripheral end edges, each wall opposed to a peripheral end edge of the other wall, said walls each being of an area sufficient to form a respective outer and inner panel, structural peripheral seam, and a flange of excess material outboard of said seam, providing an upper and lower hydroforming dies, each die having an internal forming surface matching the desired external shape of one panel of said part, said upper and lower dies each having mating perimeter lock beads adapted to close tightly together over said sheet metal blank opposed peripheral end edges as said upper and lower dies are closed together, providing a fluid inlet and seal assembly opening through the inner surface of said lower die, said fluid inlet and seal assembly having a face seal surrounded inlet port with an elongated, non circular shape and a liftable, rotatable and retractable gripper arrayed within said inlet port, providing an inlet hole in the lower blank wall associated with said one die with a shape substantially matching said inlet port and alignable therewith when said blank is aligned between said dies, aligning said blank walls with and between said respective dies and closing said dies forcefully together, thereby clamping said blank wall peripheral end edges together to simultaneously form said structural peripheral seam and flange of excess material while concurrently sealing an interior space between said blank walls, lifting, rotating and retracting said gripper, thereby pulling the outer surface of said one blank wall tightly against said inlet port and face seal, injecting pressurized fluid through said inlet hole to expand said interior space and force said blank walls into said respective die forming surfaces while preventing the loss of pressurized fluid past said face seal and between said lower blank wall and lower die inner surface, thereby forming a final part having inner and outer panels having integral sides joined by peripheral seams at the ends, and, trimming said flange of excess material.

4. A method for simultaneously shape forming a hollow, sheet metal automotive body part and joining first and second panels thereof together at a structural perimeter seam, comprising the steps of:

providing a hollow walled sheet metal blank having upper and lower walls, each wall having at least two peripheral edges, each peripheral edge opposed to a peripheral edge of the other wall, said walls each being of an area sufficient to form a respective first and second panel plus said structural peripheral seam, providing an upper and lower hydroforming dies, each die having an internal forming surface matching the desired external shape of one panel of said part, said upper and lower dies each having mating perimeter lock beads adapted to close tightly together over said sheet metal blank opposed peripheral edges as said upper and lower dies are closed together, providing a fluid inlet and seal assembly opening through the inner surface of one die, said fluid inlet and seal assembly having a face seal surrounded inlet port and a retractable gripper arrayed within said inlet port, providing an inlet hole in the one blank wall associated with said one die with a shape substantially matching said inlet port and alignable therewith when said blank is aligned between said dies, aligning said blank walls with and between said respective dies and closing said dies forcefully together, thereby clamping said blank wall peripheral edges together to simultaneously form said structural peripheral seam while concurrently sealing an interior space between said blank walls, operating the gripper to grip the one blank wall and pull the outer surface of said one blank wall tightly against said inlet port and face seal, and, injecting pressurized fluid through said inlet hole to expand said interior space and force said blank walls into said respective die forming surfaces while preventing the loss of pressurized fluid past said face seal and between said one blank wall and its respective die forming surface.

5. The method of claim 4 in which the inlet hole is a noncircular shape and the gripper is shaped to match the shape of the inlet hole but is smaller than the inlet port and the gripper is raised through the inlet hole, rotated to overlie the one blank wall, and retracted to pull the outer surface tightly against the face seal.

6. The method of claim 4 in which the gripper is a hi-lead screw which is rotated to enter the inlet hole, engage with the one blank wall and upon further rotation pulls the one blank wall tightly against the face seal.

7. The method of claim 4 in which the gripper is a screw having a self tapping thread thereon and rotation of the gripper causes the self tapping thread to engage with the one blank wall and pull the one blank wall tightly against the face seal.

8. The method of claim 4 in which the gripper is a plunger which enters the inlet hole and has gripper arms pivotally mounted thereon and retractable to engage with the one blank wall and tightly seal the one blank wall against the face seal.

* * * * *